US006065589A

United States Patent [19]

Ouwens

[11] Patent Number: 6,065,589

[45] Date of Patent: May 23, 2000

[54] PRESENTATION ELEMENT

[75] Inventor: Marco Rene Ouwens, Tilburg, Netherlands

[73] Assignee: ROMPA Kunststofprodukten B.V., Terheijden, Netherlands

[21] Appl. No.: 09/022,388

[22] Filed: Feb. 12, 1998

[30] Foreign Application Priority Data

Feb. 17, 1997 [NL] Netherlands ..... 1005295

[51] Int. Cl.[7] ..... A45C 11/04

[52] U.S. Cl. ..... 206/6.1; 206/470; 206/806; 206/756; 220/4.23

[58] Field of Search ..... 206/464, 465, 206/467, 468, 469, 470, 471, 806, 6.1, 531, 534, 756, 757, 566; 220/4.22, 4.23, 666

[56] References Cited

U.S. PATENT DOCUMENTS

| | | | |
|---|---|---|---|
| 4,158,411 | 6/1979 | Hall et al. | 206/531 |
| 4,574,954 | 3/1986 | Reid | 206/531 |
| 4,676,446 | 6/1987 | Ciocarelli et al. | 206/471 |
| 5,029,705 | 7/1991 | Schmidt et al. | 206/333 |
| 5,143,215 | 9/1992 | Hartley et al. | 206/333 |
| 5,188,222 | 2/1993 | Pierce | 206/471 |

*Primary Examiner*—Paul T. Sewell
*Assistant Examiner*—Nhan T. Lam
*Attorney, Agent, or Firm*—Jacobson, Price, Holman & Stern, PLLC

[57] ABSTRACT

The invention relates to a presentation element suitable for displaying or presenting articles intended for sale, for example ornaments, pieces of jewellery and the like, which presentation element comprises a first element part comprising edges and a central portion for accommodating an article on a first side of the first element part. The presentation element is according to the invention characterized in that it comprises a second element part connected to the first element part, which comprises edges and a deformable central portion, which second element part can be adjusted into a first position, wherein the edges of the second element part butt against the edges of the first element part, on the first side thereof, and wherein the deformable central portion envelops the article.

10 Claims, 4 Drawing Sheets

PRESENTATION ELEMENT

Figure 1:
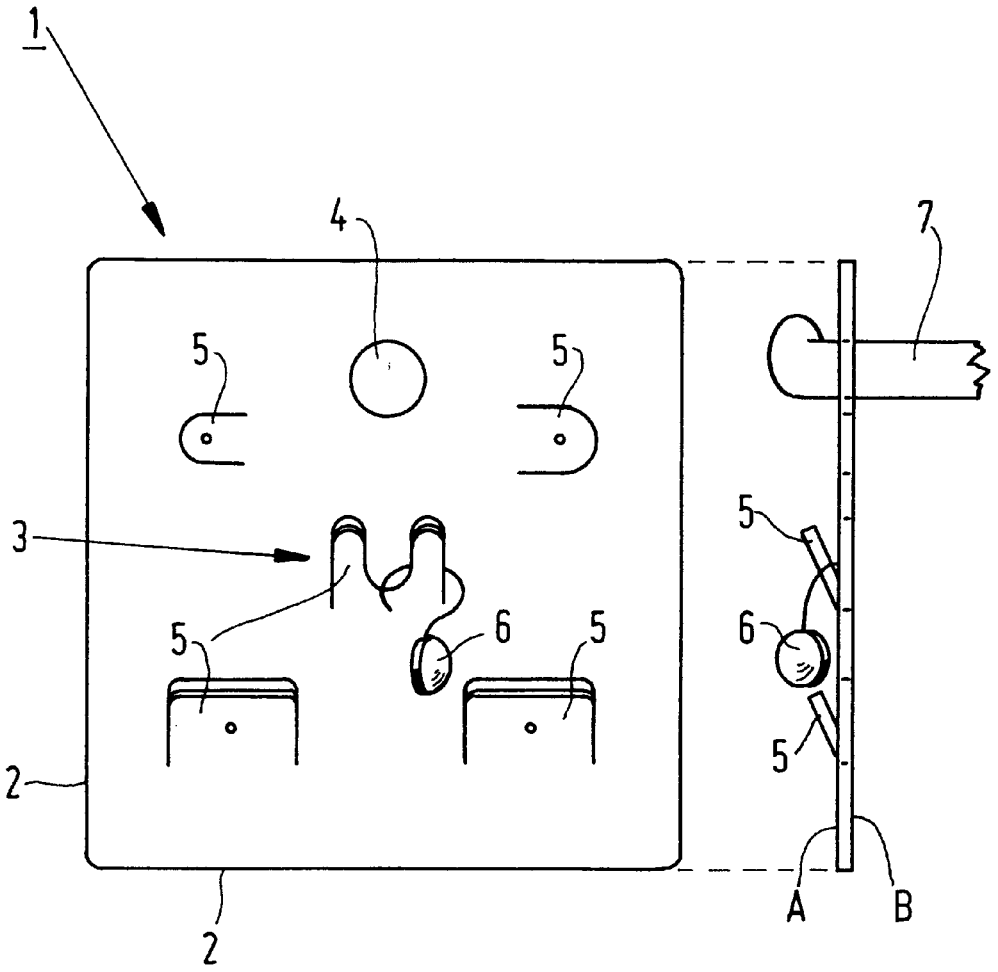

The invention relates to a presentation element suitable for displaying or presenting articles intended for sale, for example ornaments, pieces of jewellery and the like, which presentation element comprises a first element part comprising edges and a central portion for accommodating an article on a first side of said first element part.

Such a presentation element is generally known, it is generally used in boutiques, jeweller's shops, department stores and the like. The current presentation element is made up of an element part which is usually made of plastic material or cardboard, which comprises edges and a central portion provided with holes and/or cutouts. Articles intended for sale, for example ornaments, pieces of jewellery and the like, can be accommodated in the central portion of the presentation element, on a first side thereof, in order to be displayed or presented. Although a visible and customer-friendly presentation is obtained in this manner, the presentation element has the drawback that it no longer has function once the article has been purchased by the consumer. The consumer considers the current presentation element a useless, residual throw-away product, which does not have any function. In addition to that, the purchased article must be wrapped up by the shop staff as yet, whether or not together with the presentation element, which additional operations to be performed in the shop take up time and cost money, whilst furthermore additional waste material is created.

The object of the invention is to obviate the above drawbacks and to provide a presentation element comprising an additional, repeatable function for the consumer, which presentation element is easy and inexpensive to produce, which enables a reduction and a simplification of the operations to be performed in the shop, and which furthermore leads to a reduction of the amount of residual and waste material.

In order to accomplish that objective the presentation element is characterized in that it comprises a second element part connected to said first element part, which comprises edges and a deformable central portion, which second element part can be adjusted into a first position, wherein the edges of said second element part butt against the edges of said first element part, on the first side thereof, and wherein said deformable central portion envelops the article. The presentation element is thus given a packaging function as well, as a result of which the presentation element will possess an additional function which is attractive for the consumer also after the purchase of an article. This additional, repeatable packaging function enables a reduction and a simplification of the operations to be performed in the shop, which results in a saving of time and money, whilst furthermore the amount of residual and waste material is strongly reduced. Furthermore such a presentation element is strong, inexpensive and simple to produce.

According to another aspect of the invention the second element part can be adjusted into a second position, wherein the edges of said second element part butt against the edges of the first element part, on a second side thereof, and wherein said deformable central portion covers the central portion of said first element part on the second side thereof. In this position the presentation element is suitable for displaying or presenting articles intended for sale, whereby the article is presented to the consumer on the first side of the first element part, whilst the second element part is present on the second side of the first element part as a result of having been adjusted into the second position, in which position it does not cover the article. When an article is purchased by a consumer, the shop staff can adjust the presentation element from the second position into the first position by a simple operation, so that the presentation element will also have a useful function for the consumer after the purchase. All this has a time and cost-saving effect, whilst furthermore it leads to a reduction of the amount of residual and waste material.

According to another aspect of the invention the deformable central portion of the second element part is deformable from the plane of the edges. The deformable central portion of the second element part may be provided with bending and/or folding lines thereby. In this manner a simple and quick adjustment of the presentation element from the first position to the second position, and vice versa, becomes possible, as a result of which the number of operations to be performed in the shop is reduced.

In one embodiment said first and said second element part are pivotally connected, in particular by means of a single or a double film hinge. In this manner a simple; compact, inexpensive one-piece structure is obtained, which is furthermore simple to manufacture.

According to another aspect of the invention the edges of the first and the second element are provided with snap connection means. Thus a compact presentation element is obtained in the first as well as in the second position, which presentation element can readily be adjusted from the first into the second position, and vice versa.

In addition to that the first element part may be provided with means for accommodating an article. This leads to a strongly improved presentation of articles intended for sale.

Another embodiment of the invention is characterized in that the central portion of said first element part is a recessed central portion. This makes the presentation element suitable also for accommodating articles having larger dimensions, which means a considerable extension and improvement of the functionality and the possible uses of the presentation element. Said first and/or said second element part may be provided with suspension means.

The presentation element is preferably made of plastic material, in particular of polypropylene or polyethylene. Said materials are inexpensive and simple to process, so that the presentation element can be produced in large numbers by using simple production techniques, such as injection moulding techniques.

According to another aspect of the invention the first and/or the second element part are at least partially transparent. This further contributes towards improving both the functionality of the presentation element and the presentation of articles intended for sale.

Figure 2A:
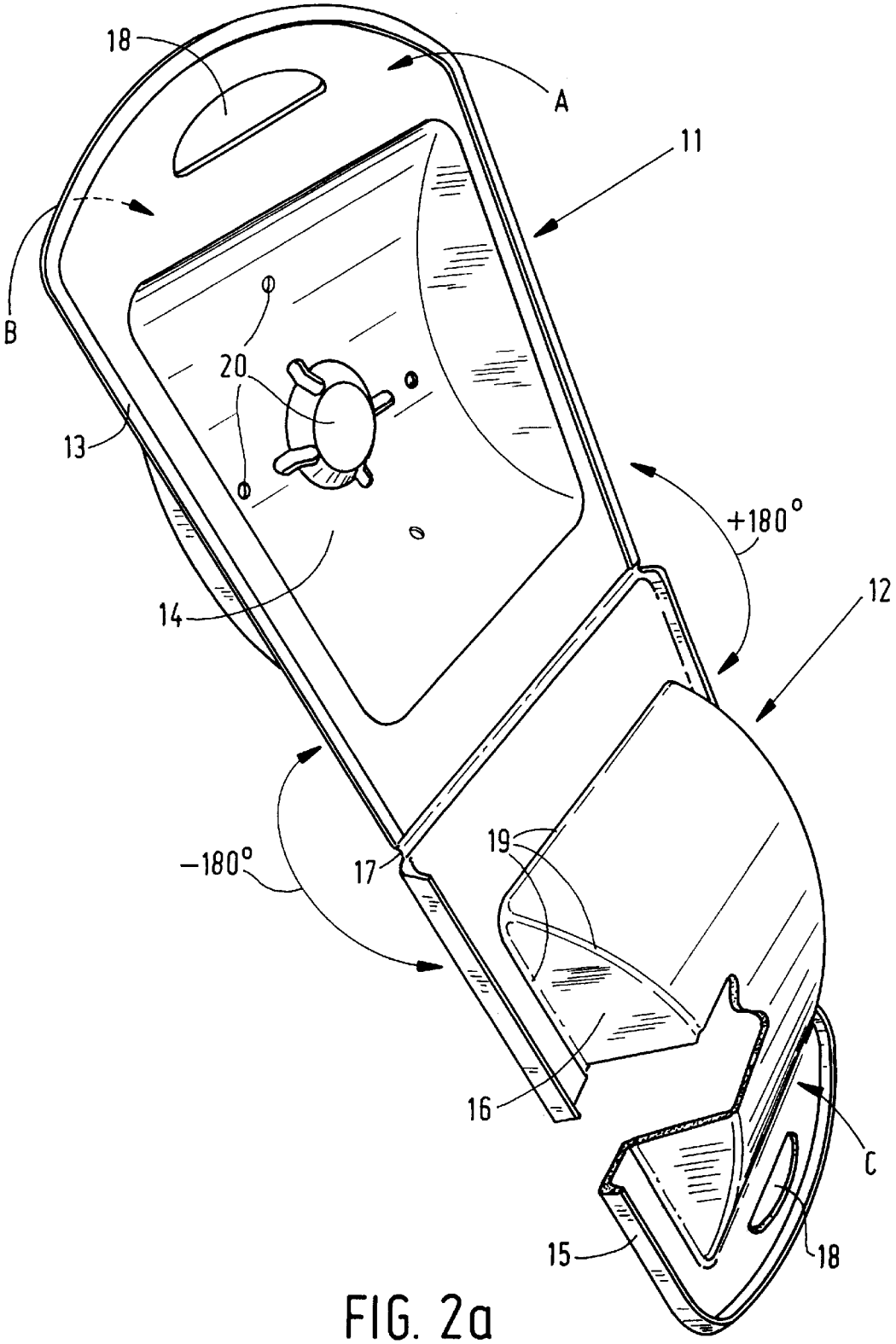
Figure 2B:
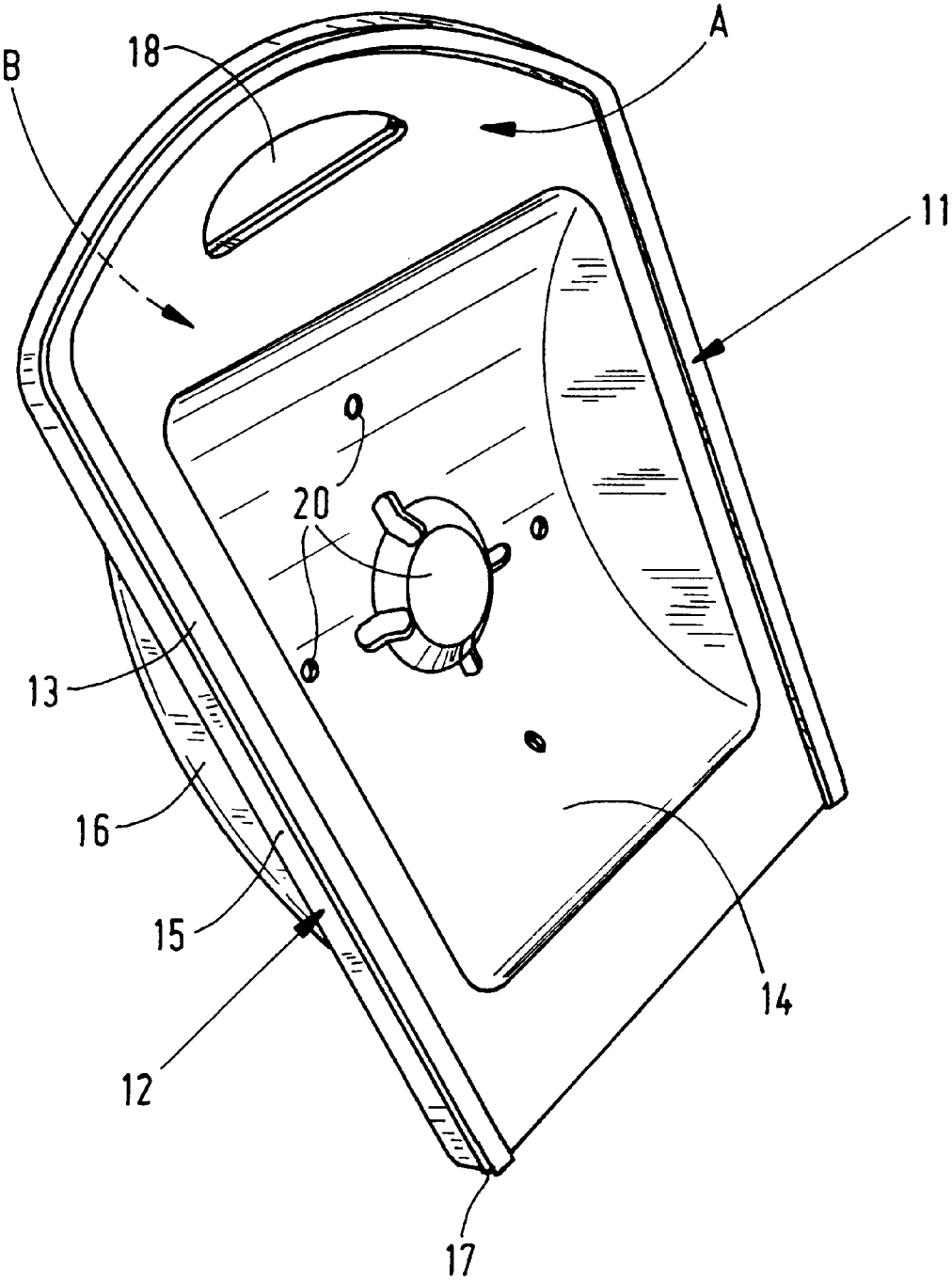
Figure 2C:
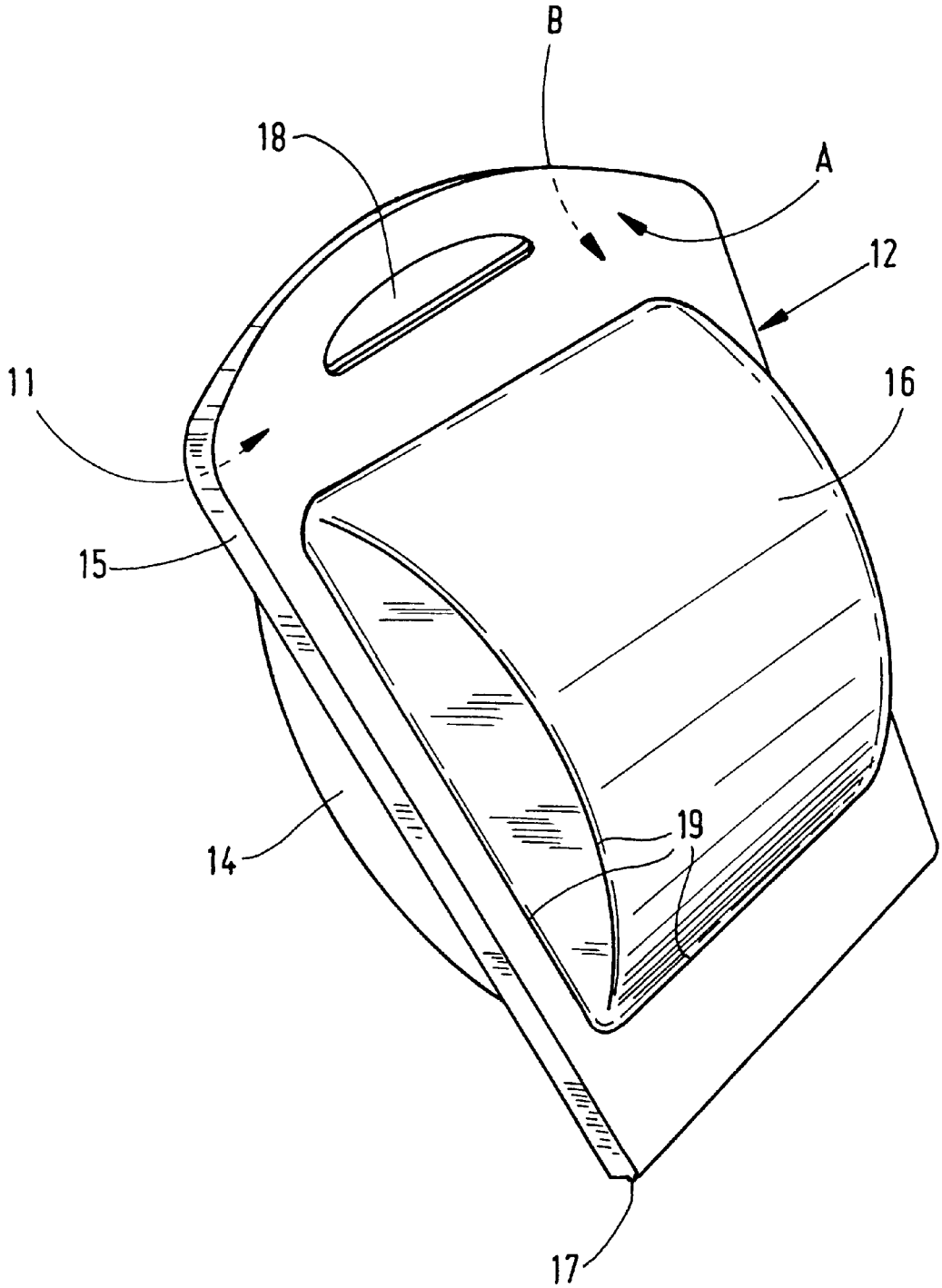

The invention will be explained in more detail hereafter with reference to a drawing. In the drawing:

FIG. 1 shows a presentation element according to prior art;

FIG. 2*a* shows an embodiment of a presentation element according to the present invention while being adjusted between the fire and the second position;

FIG. 2*b* shows the presentation element of FIG. 2*a* in the so-called presentation position;

FIG. 2*c* shows the presentation element of FIG. 2*a* in the so-called packaging position.

FIG. 1 shows a prior art presentation element. Such presentation elements are frequently used in boutiques, jeweller's shops, department stores and the like for displaying and presenting articles intended for sale, such as ornaments, pieces of jewellery and the like. In this embodiment presentation element 1 is a rectangular element which is made of a plastic material or of cardboard, and which is provided with holes and cutouts 5. Presentation element 1 comprises edges 2 and a central portion 3, which is capable of accommodating a random article 6, in this case a piece of jewellery (an earring). To that end presentation element 1 is provided with means, in this case consisting of holes and/or cutouts 5, for receiving article 6. In addition to that presentation element 1 is provided with a suspension opening 4. This makes it possible to suspend presentation element 1, together with a large number of identical presentation elements, from a hook 7 of a display or presentation device (not shown) in side-by-side relationship or in a row, in such a manner that the article 6 accommodated on a first side A is exposed to the consumer's view.

Although a visible and customer-friendly presentation of the articles is thus obtained, one drawback of the presentation element is the fact that it no longer has a function once the article has been purchased by the consumer. The consumer considers the presentation element a useless residual throw-away product, which does not have any function. In addition to that the purchased article must be packed by the shop staff as yet, which additional operations to be performed in the shop take up time and cost money, whilst furthermore additional waste material is created.

FIG. 2*a* shows an embodiment of a presentation element according to the present invention. The presentation element comprises two element parts 11 and 12, which are connected by means of a hinge 17. Plastic is a strong and inexpensive material, which is simple to process, so that the presentation element can be produced in large numbers by using simple techniques, such as injection moulding techniques. Other materials are also suitable, however. The presentation element may also consist of two separate element parts, whereby element parts 11 and 12 are connected without using a hinged joint. First element part 11 comprises edges 13 and a central portion 14, whilst second element part 12 comprises edges 15 and a central portion 16. In this embodiment means 20 for accommodating an article intended for sale are provided in central portion 14 of first element part 11. Such an article can be clamped down or attached in central portion 14 with the aid of central portion 20. In this embodiment central portions 14 and 16 of first and second element parts 11 and 12 respectively are recessed. Central portion 14 of first element part 11 may also be a flat central portion, however, that is, coincide with or extend parallel to the plane of edges 13. Recessed central portion 16 of second element part is formed in such a manner that the central portion can be deformed from the plane of edges 15. Deformable central portion 16 is provided with a number of bending and/or folding lines 19 to this end. The thickness of the material at bending and/or folding lines 19 is smaller than that of the rest of second element part 12. By exerting an external pressure force on the convex part of central portion 16, for example with one or more fingers, the material of central portion 16 can be deformed, as a result of which the material will buckle along thinner bending and/or lines 19, and the elevated central portion 16 is converted into a recessed central portion 16 on side C of the second element part. This deformation of central portion 16 along bending and/or folding lines 19 is reversible, so that second element part 12 can be formed with a recessed or with an elevated central portion 16, seen from side C, by exerting a pressure force on the convex part of central portion 16.

Double film hinge 17 enables second element part 12 to pivot through angles −180° and +180°. As is shown in FIG. 2*b*, second element part 12 comes to butt with edges 15 against edges 13 of first element part 11, on the second side thereof, when being pivoted through −180°. Since the dimensions of recessed central portion 16 are slightly larger than those of central portion 14, central portion 16 will cover central portion 14 of first element part 11 upon being pivoted through −180°. Central portion 16 of second element part 12 and central portion 14 of first element part 11 nest one into the other thereby. First side A of first element part 11 is turned toward the consumer thereby, so that an article present in central portion 14 can be displayed or presented in such a manner that it is exposed to the consumer's view. See also FIG. 2*b* in connection with this.

When pivoting takes place through +180°, the deformable central portion 16 must first be deformed by exerting an external pressure force on the convex part of central portion 16, in such a manner that, seen from side C of second element part 12, the elevated central portion 16 will deform along bending and/or folding lines 19 into a recessed central portion 16. First and second element parts 11 and 12 are joined into a compact structure upon being pivoted through a further +180°, whereby the edges 15 of second element part 12 butt against the edges 13 of first element part 11, on first side A thereof, and central portion 16 envelops central portion 14 and the article accommodated therein. See also FIG. 2*c* in connection with this.

FIG. 2*b* shows the presentation element according to the present invention in the so-called presentation position. Second element part 12 thereby butts with edges 15 against edges 13 of first element part 11, on second side B thereof, as a result of being pivoted through −180°, whereby deformable central portion 16 covers central portion 14 on side B of element part 11. In this presentation position the two suspension openings 18 coincide, so that the presentation element, together with a large number of identical presentation elements, can be suspended in side-by-side relationship or in a row in a known display or presentation device (not shown) in a shop. First side A, which accommodates an article intended for sale in central portion 14 thereof, is thereby turned towards the consumer, so that a customer-friendly presentation is obtained with such a structure, which structure takes up little space as a result of central portions 14 and 16 nesting one into the other.

FIG. 2*c* shows the presentation element according to the present invention in the so-called packaging position. When an article is purchased by a consumer, the presentation element as shown in FIG. 2*b* is adjusted by the shop staff to the packaging position as shown in FIG. 2*c* when the customer pays for the article. To this end central portion 16 is deformed along bending and/or folding lines 19 by exerting an external pressure force with one or more fingers on the convex part of deformable central portion 16 when pivoting through +180° takes place, in such a manner that central portion 16 buckles along bending and/or folding lines 19 to a recessed central portion 16, seen from side C of second element part 12. First and second element parts 11 and 12 are then joined upon being pivoted through a further +180°, in such a manner that edges 15 butt against the edges 13 of first element part 11, on first side A thereof, and central portion 16 envelops the purchased article. These operations can be quickly carried out in a simple manner by the shop staff. All this leads to a reduction and simplification of the operations to be performed in the shop, which take up time and cost money. Since the structure also provides a functional, strong and reusable packaging of the article for the consumer, the amount of residual and waste material is accordingly reduced. The use of a specific colour combination and print and/or an engraving formed during the injection moulding process furthermore makes it possible to produce a reusable package which is attractive to the consumer, which will retain its function also after the purchase of the article, and which is not considered as a useless, residual throw-away product. Possibly the two element parts 11 and 12 are transparent, at least partially so, which makes the presentation and packaging of the article more attractive. By using recessed central portions 14 and 16, the presentation element is also suitable for articles having larger dimensions and a larger volume. The edges 13 and 15 of the two element parts 11 and 12 respectively may be provided with snap connection means, so that the abutting edges clampingly engage each other both in the presentation position (FIG. 2*b*) and in the packaging position (FIG. 2*c*). Thus a compact, closed structure which takes up little space is obtained in both positions.

It will be apparent that the invention is not limited to the illustrated embodiment, and that many variants and combinations of variants are possible within the framework of the invention, which are all considered to fall within the scope of the invention. Thus the two element parts may be attached together in different manners, both in the presentation position and in the packaging position. In addition to that the central portions of the two element parts may also be made up of the entire element part, with the bending and/or folding lines coinciding with the edges of the element parts.

I claim:

1. A presentation element suitable for displaying or presenting articles intended for sale, said presentation element comprising a first element part comprising edges and a central portion for accommodating an article on a first side of said first element part, and a second element part connected to said first element part, said second element part comprising edges and a deformable central portion, the second element part being adjustable into a first position where the edges of said second element part butt against the edges of said first element part on the first side of the first element part and said deformable central portion envelops the article, and said second element part being adjustable into a second position where the edges of said second element part butt against the edges of the first element part on a second side of the first element part and said deformable central portion of said second element part covers the central portion of said first element part on the second side of said first element part.

2. A presentation element according to claim 1, wherein the deformable central portion of the second element part is deformable from the plane of the edges of the second element part.

3. A presentation element according to claim 1, wherein the deformable central portion of said second element part is provided with bending lines.

4. A presentation element according to claim 1, wherein said first and said second element part are pivotally connected by a film hinge.

5. A presentation element according to claim 1, wherein the edges of the first and the second element are provided with a snap connector.

6. A presentation element according to claim 1, wherein said first element part is provided with an article accommodater.

7. A presentation element according to claim 1, wherein the central portion of said first element part is a recessed central portion.

8. A presentation element according to claim 1, wherein at least one of said first and said second element part are provided with a suspension element.

9. A presentation element according to claim 1, wherein the presentation element is made of plastic material.

10. A presentation element according to claim 1, wherein at least one of said first and said second element part are at least partially transparent.

* * * * *